United States Patent [19]

Freese et al.

[11] Patent Number: 4,723,930

[45] Date of Patent: Feb. 9, 1988

[54] NOAH'S ARK TOY

[75] Inventors: Lawrence O. Freese, Providence, R.I.; John R. Nottingham; John W. Spirk, both of Moreland Hills, Ohio; Martin J. Wolff, North Providence, R.I.

[73] Assignee: Dart Industries Inc., Deerfield, Ill.

[21] Appl. No.: 886,868

[22] Filed: Jul. 16, 1986

[51] Int. Cl.[4] ..... A63H 17/00; A63H 3/00; A63H 23/02; G09B 19/00

[52] U.S. Cl. ..... 446/93; 446/72; 446/160; 446/268; D21/130; 434/259

[58] Field of Search ..... 446/69, 71, 72, 73, 446/75, 76, 93, 85, 94, 97, 99, 100, 101, 153, 227, 160, 230, 231, 268, 385, 388; D21/130; 434/259, 258, 373

[56] References Cited

U.S. PATENT DOCUMENTS

| | | | |
|---|---|---|---|
| D. 258,071 | 1/1981 | Walker | D21/130 |
| D. 281,264 | 11/1985 | Spirk, Jr. et al. | D21/130 |
| 1,026,861 | 5/1912 | Haskell | 446/388 |
| 2,113,427 | 4/1938 | Fleisig | 446/73 X |
| 3,126,669 | 3/1964 | Gausewitz | 446/160 |
| 3,236,007 | 2/1966 | Abeson | 446/388 X |
| 3,400,485 | 9/1968 | Callin et al. | 446/76 |
| 3,561,155 | 2/1971 | Tarrson | 446/93 X |
| 4,131,227 | 12/1978 | Patton et al. | 446/76 X |
| 4,223,894 | 9/1980 | Fabricant | 446/160 X |
| 4,519,788 | 5/1985 | Ajiro et al. | 446/99 X |

FOREIGN PATENT DOCUMENTS

| | | | |
|---|---|---|---|
| 543223 | 9/1959 | Belgium | 446/385 |
| 963263 | 7/1950 | France | 446/268 |
| 1002115 | 3/1952 | France | 446/99 |
| 1287382 | 2/1962 | France | 446/73 |
| 564361 | 7/1975 | Switzerland | 446/73 |
| 599468 | 9/1946 | United Kingdom | 446/99 |

*Primary Examiner*—Robert A. Hafer
*Assistant Examiner*—D. Neal Muir

[57] ABSTRACT

An ark toy comprising an ark including a hull, a deck releasably snap-locked to the hull, and a cabin releasably snap-locked to the deck. The cabin incorporates a handle for carrying the entire assembly. Animal units are releasably assembled companion animal members and are selectively mountable within deck compartments with access to and from the deck simulated by a removable inclined ramp.

28 Claims, 12 Drawing Figures

NOAH'S ARK TOY

BACKGROUND OF THE INVENTION

The Biblical story of Noah and the flood has long been a favorite with children and particularly lends itself for telling to small children intriqued with the ingathering of the animals of the world two-by-two on the ark. As such, the ark whether specifically so designated, or apparent from the unique stylized configuration thereof, has been, on several occasions, reproduced as a toy. Examples thereof will be noted in the following patents:

No. Des 140,088 Russell Jan. 23, 1945

No. Des 229,846 Rae et al Jan. 8, 1974

No. Des. 230,366 Schmidt et al Feb. 12, 1974

While such toys are an aid to the telling of the story of Noah and the flood, and function as a play item for the child, either in the nature of a pull toy or a floating boat, they are of little value insofar as physical teaching aids encouraging and teaching manual dexterity, configuration and spatial relationship, and the like.

SUMMARY OF THE INVENTION

The present invention is a Noah's ark toy comprising the ark, Noah and his wife, multiple pair of animals, and a ramp, all of which interrelate in a manner which allows for a simplified telling of the story of the gathering of the animals, and will simultaneously provide for an exercise in manual dexterity and spatial relationships in the assembly and manipulation of the components.

It is also intended that selected ones of the basic components of the toy be, themselves, formed of multiple interrelated elements capable of assembly and disassembly, in each instance requiring the exercise of basic mechanical skills.

More particularly, the ark includes three elements, a chamber-defining hull, a deck frictionally engaged with and snap-locked to and over the hull, and a cabin supported on the deck and snap-locked thereto. In each instance the snap-locking means incorporates enlarged manipulative tabs which are particularly adapted as a simplified release means for small children. The chamber defined by the hull allows for storage of others of the components, such as the ramp, Noah and his wife, and the like. The cabin, uppermost on the ark, includes a specifically configured roof portion wherein the ridge area defines a handle allowing for a ready grasping and carrying of the toy by a child.

The animals themselves are provided in pairs with the animals of each pair having duplicate outer profiles with releasable mating connector elements for a side-to-side joinder of the animals into a unit of two duplicate animals. Each animal unit differs from the other animal units both in the animal configuration and in the connector components to preclude a misjoinder.

The ramp is specifically configured to releasably engage the deck rail of the ark to provide an inclined surface along which the animals can be moved. A series of steps are provided on the ramp which are configured to closely accomodate the feet of the animals and thus provide a support for the animals to allow for a free-standing of the animals on the ramp. The deck of the ark includes a central well divided into a series of compartments, each compartment accomodating a pair of standing animal units oriented to face outwardly to the opposite sides of the ark. The deck also includes forward and aft cockpits receiving small doll-like representations of Noah and his wife.

DESCRIPTION OF PREFERRED EMBODIMENT

Figure 1:
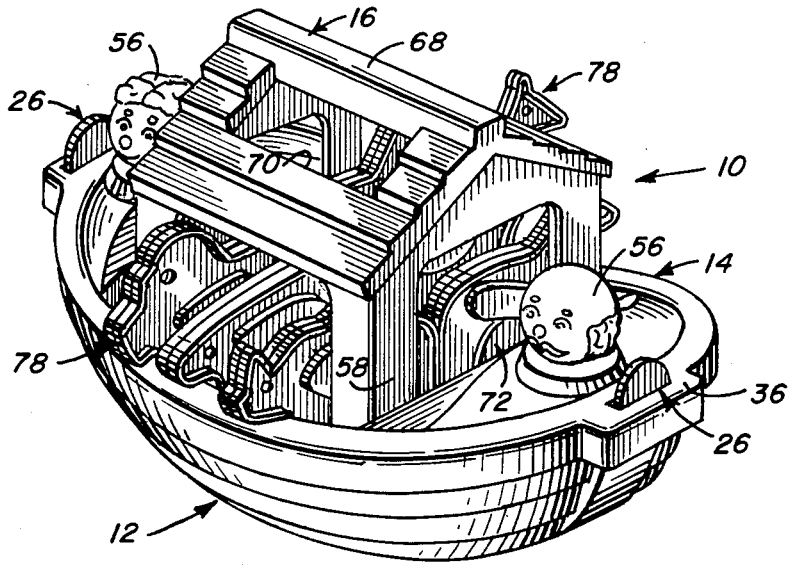
FIG. 1 is a perspective view of the toy of the present invention with all of the components assembled.

Referring now more specifically to the invention, reference numeral 10 is used to generally designate the ark. The ark 10 is formed of three readily seperable interconnected members, the hull 12, the deck 14 and the cabin 16.

The hull 12, which forms the base of the toy, is a one-piece molded member including a flat bottom 18 with bowed sides 20, simulating lapped planking, rising therefrom. The opposed sides 20 define narrow bow and stern ends with a simulated keel 22 running centrally along the hull and terminating in upwardly directed bow and stern keel stems 24.

The side walls 20 terminate in an upper edge continuous between the upper ends of the keel stems 24, with the side walls 20 and hull bottom 18 defining a bilge chamber. A pair of locking tabs 26 extends upwardly above the upper wall edge as integral planar continuations of the forward and aft keel stems 24. Each of these tabs 26, at a point immediately above the hull edge, is provided with an outwardly directed lug 28 defining a laterally directed locking shoulder. It is contemplated that each of the tabs 26 be inherently resilient and flexible for a selective engagement and withdrawal of the associated locking lug 28 as shall be explained subsequently. The actual flexibility of each of the tabs 26 can be enhanced by the provision of a pair of slits or slots 29 extending the effective length of the opposed sides at the tab downward into the hull below the upper edge thereof, allowing for an increased flexure of the tab below and independently of the upper edge portion of the hull. As will be appreciated, the tabs 26 are relatively wide and project a substantial distance above the upper edges of the hull side walls 20. This is particularly significant in providing for easy access thereto and manipulation thereof by the very young.

The deck 14 includes a peripheral rail 30 received over the upper edge of the hull 12 completely thereabout, the rail 30 including a full length depending flange 32 which closely confines the upper portion of the hull 20. An integral rib 34 is defined longitudinally along the exterior of each of the side walls 20 and forms a seat for the lower edge of the peripheral flange 32. This rib 34 will, at the same time, simulate a boat rubrail.

The deck rail 30, at both ends of the deck 14, projects outwardly along the centerline area of the deck to define projections 36, the peripheral flange 32 extending continuously about such projections and functioning as a strengthening means. The projections in turn conform to and enclose the upper portions of the two keel stems 24.

Figure 4:
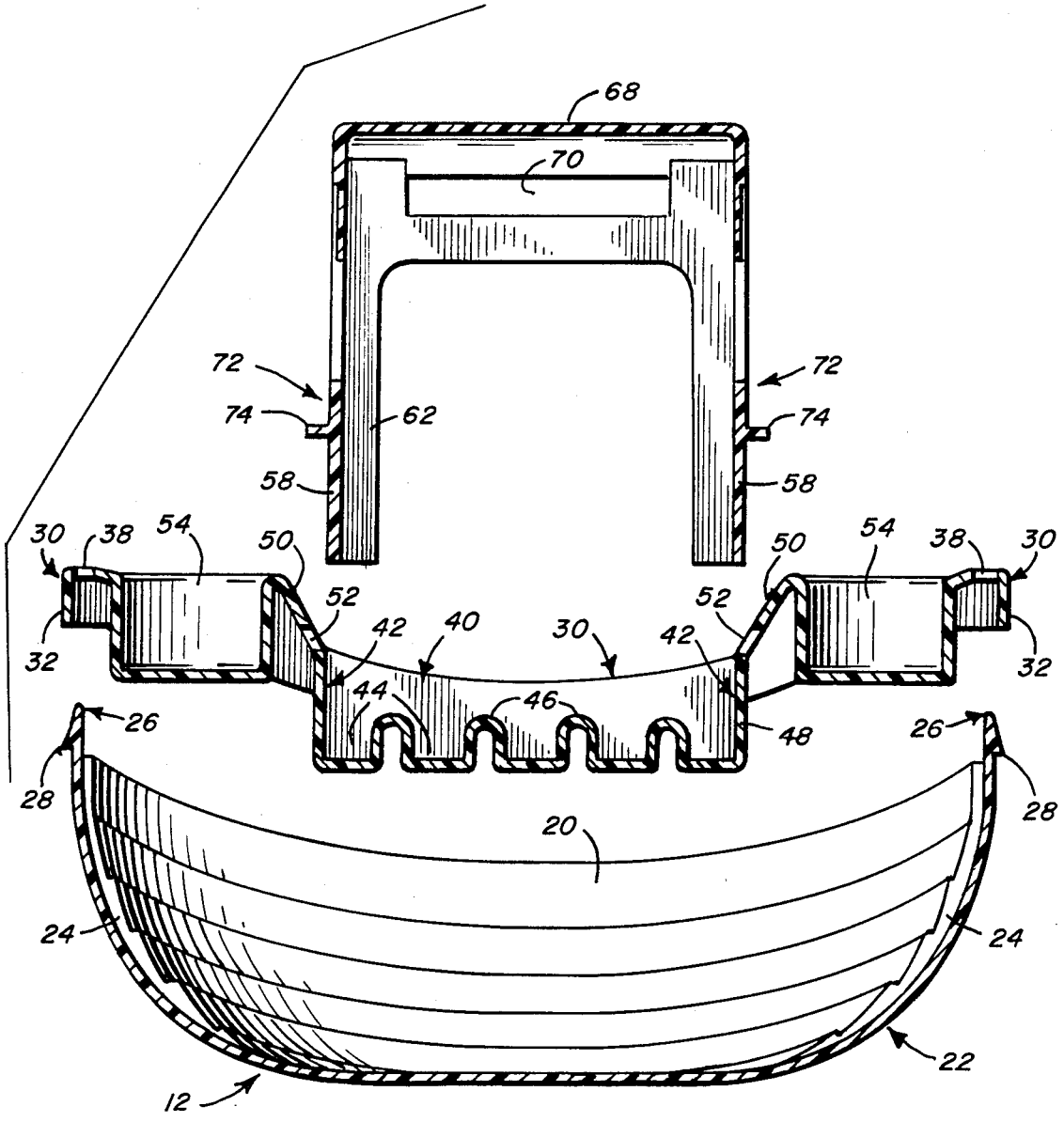
FIG. 4 is an exploded perspective view, in section, of the separate elements of the ark.
Figure 6:
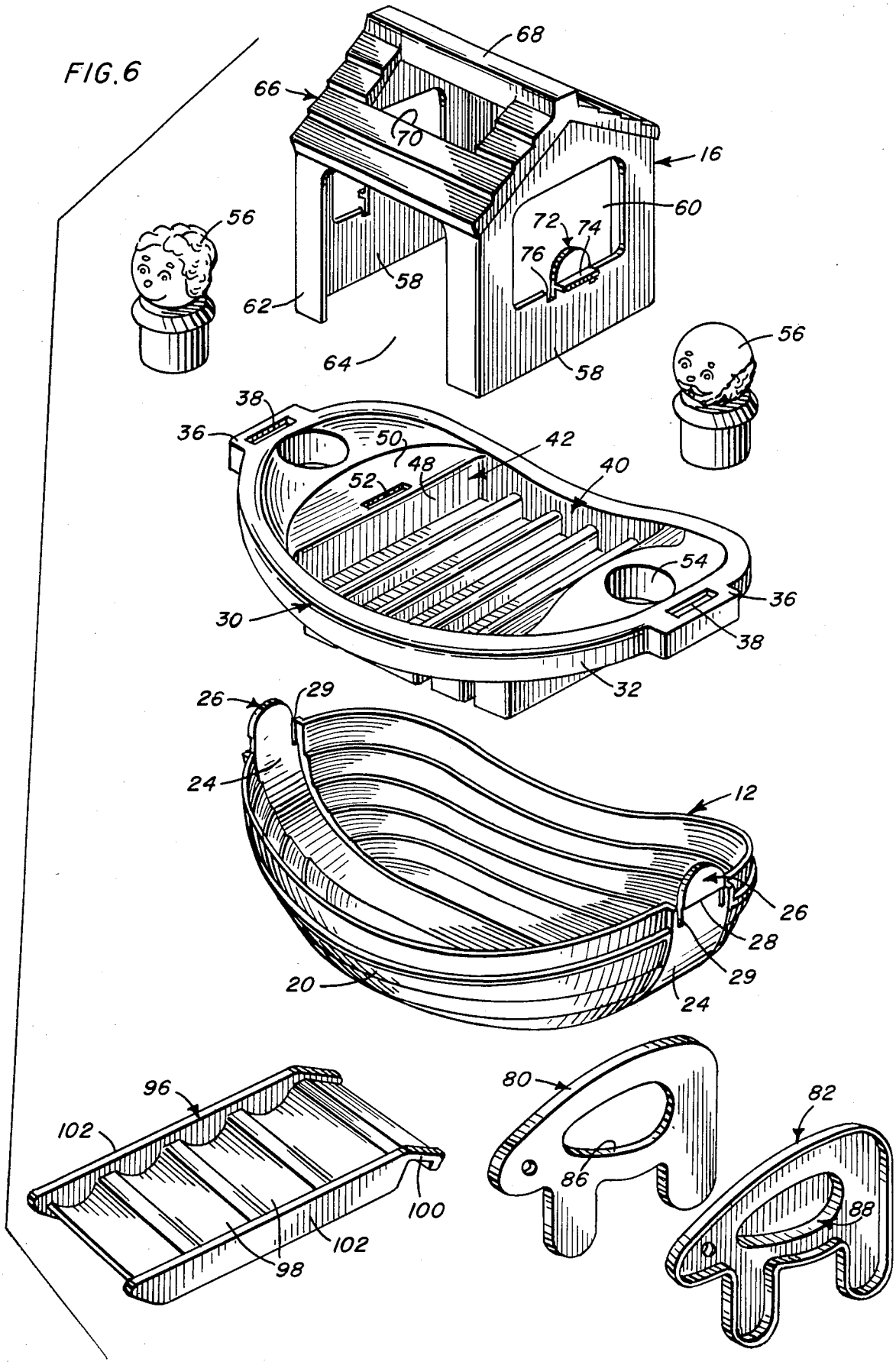
FIG. 6 is an exploded perspective view of all of the components of the toy with one animal unit represented.
Figure 7:
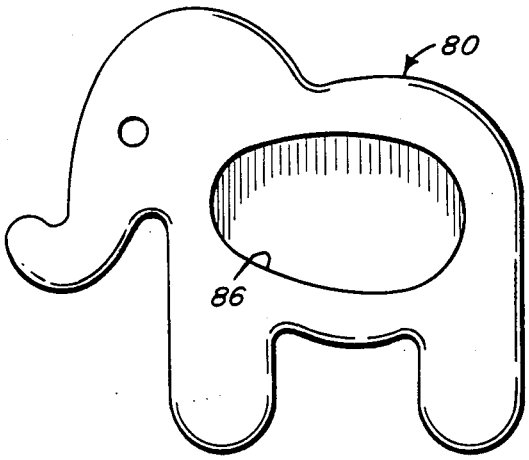
FIG. 7 is an inner side view of one animal member.
Figure 8:
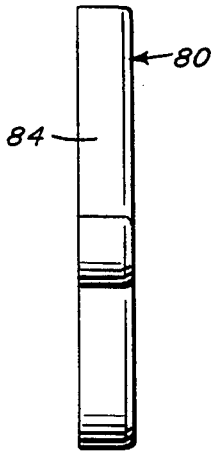
FIG. 8 is a front elevational view of the animal member of FIG. 7.
Figure 9:
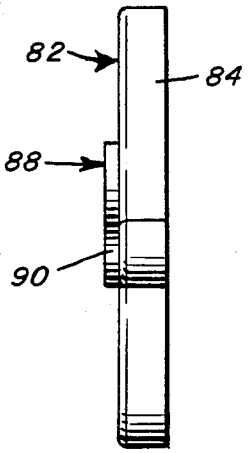
FIG. 9 is an inner side view of the mating animal member.
Figure 10:
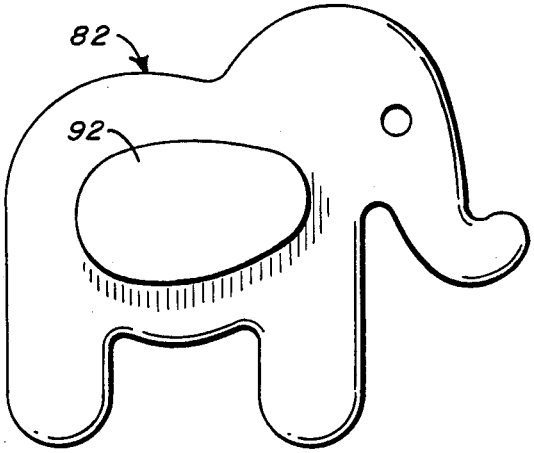
FIG. 10 is a front elevational view of the animal member of FIG. 9.
Figure 11:
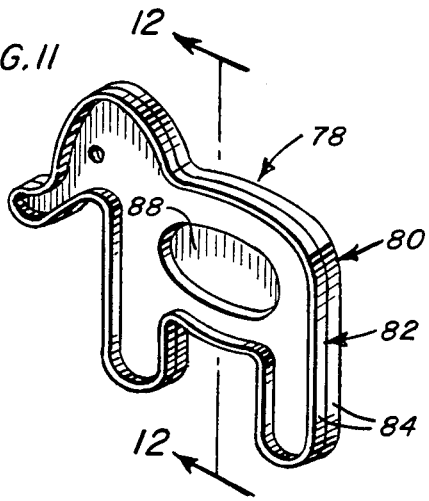
FIG. 11 is a perspective view of an animal unit comprising a pair of joined animal members.

Each of the projections 36 includes an elongate transverse slot 38 therethrough. Upon a positioning of the deck 14 over the hull 12, the upwardly projecting tabs 26 generally align with the slots 38 for the reception of the tabs therethrough as the deck is moved downwardly into seated position on the hull. The tabs 26, in order to provide for an automatic snap locking through the slots 38, are so positioned as to require a slight longitudinal inward flexing to allow passage of the corresponding lugs 28 through the slots, after which the inherent resiliency of the tabs 26 will shift the lugs 28 outward into overlying and retaining relation to the rail or projection portion 36 thereof. As suggested in FIGS. 2 and 4, the outer surface of each of the tabs 26, above the lugs 28, can be tapered from a narrow upper extreme to the downwardly directed lug-defining shoulder to allow for an automatic inward flexing of the tabs 26, relative to the length of the hull, as the deck and hull are moved into engagement with each other. While a positive interlock is thus provided between the deck and the hull, release of the deck is easily effected by a simultaneous or individual inward movement of the tabs so as to release the lug or lugs, followed by an outward shifting of the deck relative to the hull. The enlarged nature of the tabs facilitates manipulation thereof by the very young. Further, the flexible nature of the tabs allow for an individual disengagement of first one tab and then the other.

The deck 14 itself includes an enlarged central well 40 defined by the opposed side portions of the rail 30 and by forward and aft bulkheads 42. The well is divided into multiple full width upwardly directed compartments 44 defined by integral upwardly projecting transversely extending dividers or divider ribs 46.

Each of the bulkheads 42 includes a lower vertical wall portion 48 rising from the bottom of the well 40 and an upward and outwardly inclined wall portion 50. A transversly elongate locking slot 52 is provided through the outwardly angled wall portion 50 immediately above the vertical wall portion 48 of each bulkhead.

Immediately outward of the bulkheads 42, and more particularly the upper angled wall portions 50 thereof, are a pair of forward and aft cockpits 54 in the nature of cylindrical recesses which removably receive the dolls 56 respectively representing Noah and Noah's wife. Each of the dolls 56 includes a cylindrical base received within the corresponding cockpit 54 and a figure simulating upper portion.

The cabin 16 is an integrally formed unit usable either on the deck 14, nestled within the well 40 thereof, or as a freestanding shelter. Oriented in the deck well, the cabin 16 includes forward and aft walls 58 having enlarged windows 60 defined therethrough. The opposed side walls 62 have enlarged doorways or openings 64 therein which provide for entry and egress to and from the cabin. A gable roof 66 is provided with a longitudinally extending central ridge portion 68. The roof 66, to each side of the central ridge portion 68, includes enlarged hand-accomodating openings 70 which allow for a grasping of the ridge portion 68 in the manner of a convenient handle, both for the cabin 16 as a separate unit and for the entire ark upon a mounting of the cabin 16 as shall be explained.

In order to effect a releasable mounting of the cabin 16 to the deck 14 and within the well 40 thereof, each of the end walls 58 includes an integral wide planar manipulating tab 72 projecting centrally into the corresponding window opening 60 upward from the lower edge or sill portion thereof. Each of the tabs 72 includes an outwardly projecting lug 74 which is adapted to snap-lock within the corresponding bulkhead slot 52. Basically, the length of the cabin, between the ends walls 58, generally corresponds to the length of the well 40 with the end walls 58 being positionable immediately inward of the forward and aft bulkhead 42. In this manner, as the cabin 16 is introduced into the well 40, guided by inclined wall portions 50, the tab lugs 74 will engage against the inclined wall portions 50 of the bulkheads 42 and cause a slight inward flexing of the tabs 72 until the lugs 74 align with the slots 52. At that point, the inherent resiliency of the tabs 72 will cause an outward rebounding thereof and a corresponding locking of the lugs 74 within the slots 52. In order to increase the flexibilty of the tabs 72 and move the area of flexure below the sill edge of the windows 60, each of the tabs 72 is, in effect, extended below the corresponding window edge by a pair of vertical side slots 76 in the end walls 58 immediately to each side of each tab 72. As will be appreciated, the tabs 72 are readily accessible and easily manipulated for facilitating assembly and disassembly by young children. By the same token, the lugs 74 define, when engaged within the corresponding slots 52, a positive interlock whereby the entire ark assembly can be carried by the roof-defined carrying handle.

Figure 2:
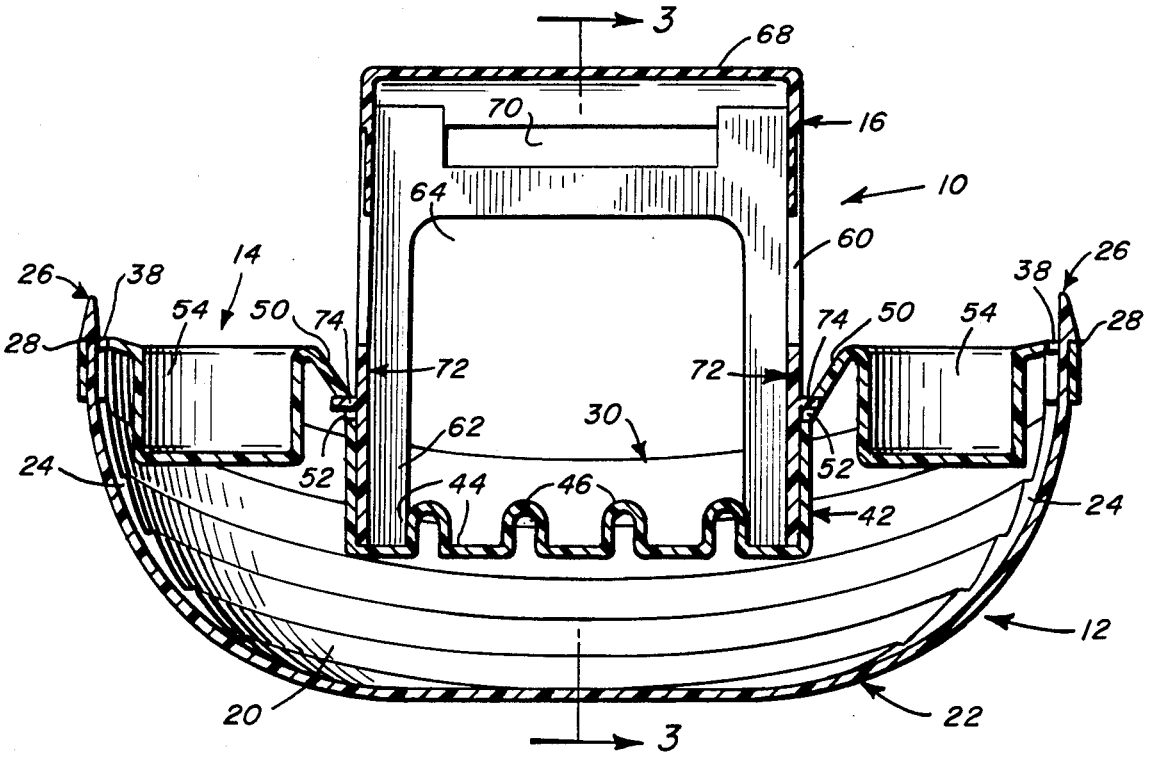
FIG. 2 is a longitudinal cross-sectional view through the art.
Figure 3:
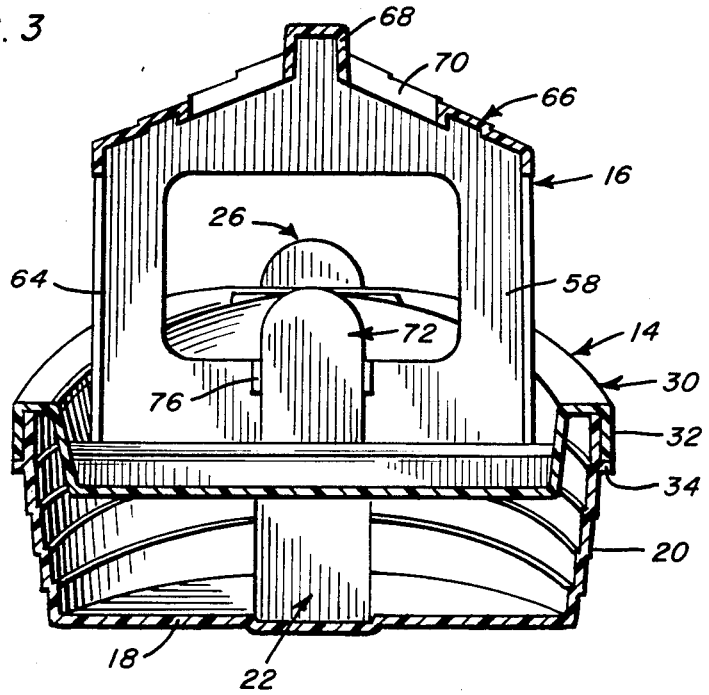
FIG. 3 is a transverse cross-sectional view taken substantially on a plane passing along line 3—3 in FIG. 2.

Noting FIG. 2 in particular, the cabin fully seats within the outermost two well compartments upon engagement of the lugs 74 within the corresponding bulkhead slots 52, thus providing a secure interfit. It will also be appreciated that the width of the cabin side walls 62, to each side of the central door 64, closely conforms to the width of the end compartments to preclude any longitudinal shifting of the cabin 16 relative to the deck well 40.

The remaining upwardly opening well compartments 44 are specifically adapted to receive animal units 78 arranged back-to-back therein. The length of two animal units, as well as the width of the animal units are such as to allow for a free inroduction thereof into and removal from the well compartments 44.

As will be appreciated from the drawings, distinct animal units are provided for a variety of different types of animals. In each case the animal units 78 consist of two animal members 80 and 82 having duplicate outer profiles or configurations and being basically planar members with a peripheral rigidifying flange 84 projecting from the outer face thereof. When assembled, the inner faces of the animal members 80 and 82 are abutted against each other with the flanges 84 projeoting outwardly to opposite sides of the unit. The flanges 84, in addition to providing strength and rigidification, also provide, at the bottom of the formed legs, a relaively broad base to allow for a freestanding of the animal unit 78.

Figure 12:
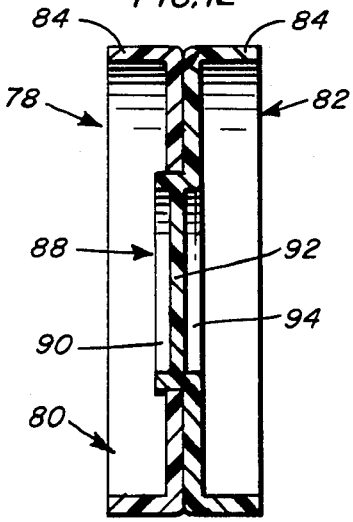
FIG. 12 is an enlarged cross-sectional detail taken substantially on a plane passing along line 12—12 in FIG. 11 and illustrating the connector means.

The animal members 80 and 82 of each animal unit 78 include releasable connector means for a joinder thereof, providing for a two-by-two relationship in accord with the story of Noah. Such connector means includes a specifically configured aperture 86 defined centrally through the body of animal member 80, and a correspondingly configured projection 88 extending from the inner face or side of the second animal member 82. The projection, noting the detail of FIG. 12, can comprise an edge-defining flange 90 with an internal web 92 parallel to the side of the animal member 82 but offset slightly therefrom to define a corresponding depression 94 in the outer face of the animal member 82. The projection 88 is specifically adapted for frictional engagement within the aperture 86 for a releasable locking of the animal members in side-by-side relation to define the unit 78.

It is specifically intended that the connector means, that is the aperture 86 and aperture receiving projection 88 of each animal unit, differ from those of all of the other animal units to preclude a mismatching of the animal members. Thus, a child, upon a proper matching of the animal members by a comparison of the profiles, will be rewarded by a positive interlock between the matched animals. Should the animals not match, an interlock will not be possible and thus provide an indication to the child that further investigation or experimentation is necessary to correctly pair the animal members.

Figure 5:
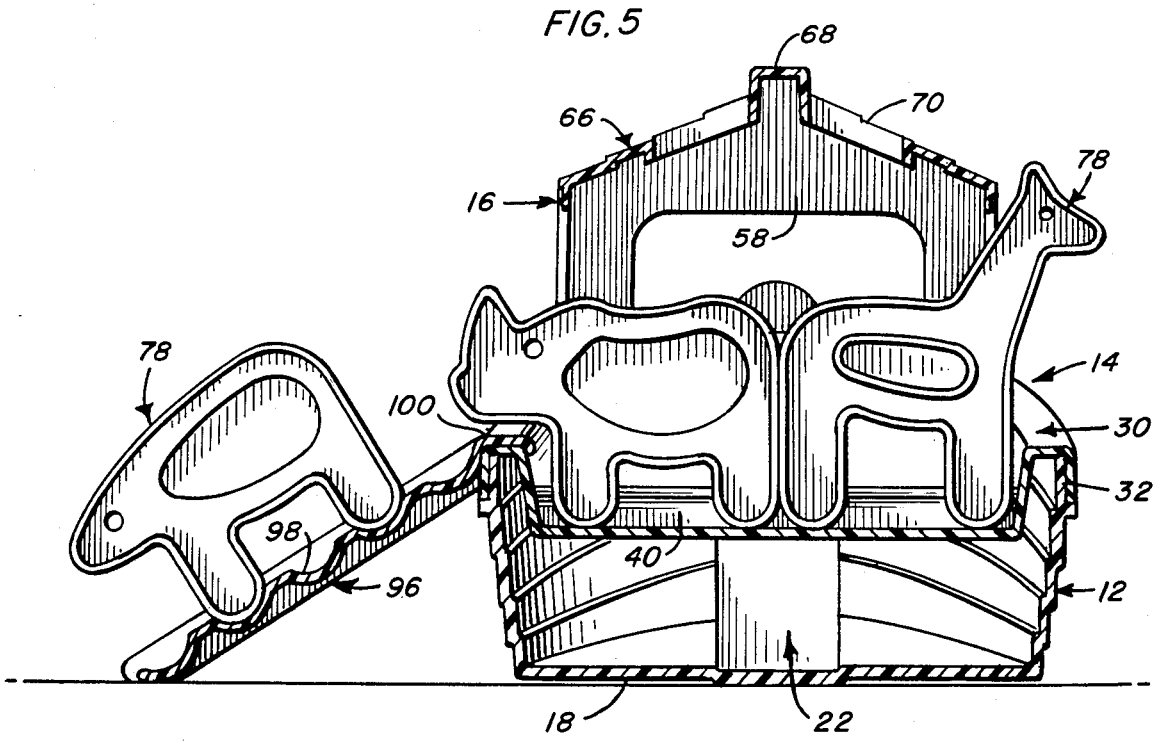
FIG. 5 is a cross-sectional view similar to FIG. 3 with the ramp mounted in position and animal units both within the ark and on the ramp.

In order both to introduce the animal units to the ark and remove the animal units therefrom in a realistic manner, an elongate ramp 96 is provided. The ramp 96, also an integrally formed member, includes multiple steps 98 transversely thereacross and defined as arcuate grooves configured to compliment the arcuately configured lower ends or feet of the animal units 78 whereby the animals units 78, as suggested in FIG. 5, can stand on the ramp. As will be appreciated, this also of course necessitates a spacing of the arcuate steps 98 to conform to the spacing of the animal unit legs. It also will be noted that while the animal units are of different profiles, there are some basic similarities therebetween, including the leg spacing and configuration, and the provision of generally vertical rear edges.

The ramp 96 includes a downwardly turned gripping upper edge portion 100 which is adapted to engage over the deck rail 30, the ramp 96 being of a length to incline outwardly from the deck rail at a relatively gentle slope to an outer ground engaging end.

The ramp 96 will also incorporate opposed longitudinally extending side rails 102 which stabilize the central step-forming portion of the ramp 96, as well as provide side barriers tending to retain the animal units 78 on the ramp as the animal units are moved therealong.

The ramp 96, when not in use, can be stored within the enlarged chamber provided within the hull 12 below the deck 14. Similarly, the doll Figures 56 and at least some, if not all, of the animal units 78, can also be stored therein with the ark, through the roof-defined handle, functioning as a carrier for the various component parts.

The assembled ark provides, through the deck compartments, a stable reception area for the animal units, while at the same time allowing for easy access thereto for both the introduction and removal of the animal units. As a manual dexterity challenge for small children, the parts of the ark are capable of being selectively assembled and disassembled, primarily through manipulation of enlarged easily engaged tabs incorporating lugs for snap-fitting with corresponding slotted members. As will be appreciated from the assembled view of FIG. 1 in particular, the tabs are readily accessable while effectively blending into the overall configuration and construction of the ark.

The animal units themselves, while presenting a challenge for young children in mating the corresponding animal members, provide for a simplified means of connecting the properly mated members as well as subsequently disengaging the animal members. With regard to the disengagement of the animal members, it will be appreciated that the central web 90 provided within the flange-defining projection 88 on animal member 82 will allow the child to merely push thereagainst to disengage the members.

We claim:

1. An ark toy comprising separable elements including a hull, a deck and a cabin, said hull comprising a bottom, opposed sides, a bow and a stern, said sides extending upwardly from said bottom and longitudinally between said bow and stern, bowing outward therebetween to define a bilge chamber, said hull having an upper edge defined by said sides, each of said bow and stern including a hull tab projecting above the upper edge of the hull, said deck including a peripheral rail receivable over the upper edge of said hull, said rail having a pair of apertures defined vertically therethrough for receiving said hull tabs, each hull tab including a laterally directed lug engageable with said rail upon reception of the tab through the corresponding aperture to preclude retraction of said tab, said tabs being resiliently flexible for manual alignment of the lugs with said apertures for a withdrawal of the tabs therethrough, a central well in said deck, said cabin overlying said well and releasably interlocking with said deck.

2. The ark toy of claim 1 wherein said central well includes forward and aft bulkheads, each bulkhead having an aperture therein, said cabin including forward and aft walls received within said well immediately inward of said bulkheads, a cabin tab on each of said forward and aft cabin walls, a retaining lug on each cabin tab extending laterally outward thereof for locking engagement within the corresponding bulkhead aperture, said cabin tabs being resiliently flexible for a manual flexing thereof for withdrawing the associated lugs from the corresponding bulkhead apertures.

3. The ark toy of claim 2 wherein said cabin includes a roof transverely between said forward and aft walls, said roof including a central ridge portion, and a hand opening to each side of said ridge portion for engagement of the ridge portion in manner of a handle.

4. The ark toy of claim 1 in combination with multiple animal units, said well including a series of laterally adjacent upwardly opening compartments receiving said animal units.

5. The ark toy of claim 4 including a ramp, said ramp including a rail-engaging upper end, said ramp being adapted to extend obliquely from the upper end engaged with the rail to a lower end outwardly spaced from the hull and below said deck, said ramp having step means therealong between said upper and lower ends, said animal units including feet portions, said step means being contoured to receive and conform to the feet portions of said animal units.

6. The ark toy of claim 5 wherein well compartments are each of a length generally equal to the combined length of a pair of aligned animal units, each compartment being of a width generally equal to the width of a single animal unit.

7. The ark toy of claim 6 wherein each animal unit comprises a pair of animal-shaped members with duplicate outer profiles and releasable mating connecter elements for a side-to-side joinder of said members.

8. The ark toy of claim 7 wherein the animal-shaped members of each animal unit differ from those of every other animal unit.

9. The ark toy of claim 8 wherein the mating connecter elements of each animal unit differ from those of every other animal unit.

10. The ark toy of claim 9 wherein the animal-shaped members of each animal unit include facing inner sides and outwardly directed outer sides, the mating connecter elements of each animal unit including an aperture through one animal-shaped member opening through the inner side thereof, and a projection extending from the inner side of the second animal-shaped members, said projection corresponding in a shape to the aperture in the one animal-shaped member and being frictionally receivable therein.

11. The ark toy of claim 10 wherein said deck includes a pair of upwardly opening recesses therein forward and aft of said well for the positioning of toy figures.

12. The ark toy of claim 1 in combination with multiple animal units, said well including a series of laterally adjacent upwardly opening compartments receiving said animal units.

13. The ark toy of claim 12 including a ramp, said ramp including a rail-engaging upper end, said ramp being adapted to extend obliquely from the upper end engaged with the rail to a lower end outwardly spaced from the hull and below said deck, said ramp having step means therealong between said upper and lower ends, said animal units including feet portions, said step means being contoured to receive and conform to the feet portions of said animal units.

14. The ark toy of claim 12 wherein well compartments are each of a length to closely receive a pair of aligned animal units, each compartment being of a width equal to the width of a single animal unit.

15. The ark toy of claim 12 wherein each animal unit comprises a pair of animal-shaped members with duplicate outer profiles and releasable mating connecter elements for a side-to-side joinder of said members.

16. The ark toy of claim 15 wherein the animal-shaped members of each animal unit differ from those of every other animal unit.

17. The ark toy of claim 16 wherein the mating connecter elements of each animal unit differ from those of every other animal unit.

18. The ark toy of claim 17 wherein the animal-shaped members of each animal unit include facing inner sides and outwardly directed outer sides, the mating connecter elements of each animal unit including an aperture through one animal-shaped member opening through the inner side thereof, and a projection extending from the inner side of the second animal-shaped member, said projection corresponding in shape to the aperture in the one animal-shaped member and being frictionally receivable therein.

19. In an ark toy, an ark comprising separable elements including a hull and a deck said hull comprising a bottom, opposed sides a bow and a stern, said sides extending upwardly from said bottom and longitudinally between said bow and stern, bowing outward therebetween to define a bilge chamber, said hull having an upper edge defined by said sides, each of said bow and stern including a hull tab projecting above the upper edge of the hull, said deck including a peripheral rail receivable over the upper edge of said hull, said rail having a pair of apertures defined vertically therethrough for receiving said hull tabs, each hull tab including a laterally directed locking lug for releasable locking engagement with said rail upon reception of the tab through the corresponding aperture, a central well in said deck, and multiple animal units, said well including a series of laterally adjacent upwardly opening compartments receiving said animal units, said well compartments each being of a length to receive a pair of aligned animal units and of a width equal to the width of a single animal unit.

20. The ark toy of claim 19 wherein each animal unit comprises a pair of animal-shaped members with duplicate outer profiles and releasable mating connecter elements for a side-to-side joinder of said members.

21. The ark toy of claim 20 wherein the animal-shaped members of each animal unit differ from those of every other animal unit.

22. The ark toy of claim 21 wherein the mating connecter elements of each animal unit differ from those of every other animal unit.

23. The ark toy of claim 22 wherein the animal-shaped members of each animal unit include facing inner sides and outwardly directed outer sides, the mating connecter elements of each animal unit including an aperture through one animal-shaped member opening through the inner side thereof, and a projection extending from the inner side of the second animal-shaped member, said projection corresponding in shape to the aperture in the one animal-shaped member and being frictionally receivable therein.

24. The ark toy of claim 19 including a ramp, said ramp including a rail-engaging upper end, said ramp being adapted to extend obliquely from the upper end engaged with the rail to a lower end outwardly spaced from the hull and below said deck, said ramp having step means therealong between said upper and lower ends, said animal units including feet portions, said step means being contoured to receive and conform to the feet portions of said animal units.

25. An ark toy comprising a hull and a deck, said hull comprising a bottom, opposed sides and a keel including bow and stern keel stems, said sides extending upwardly from said bottom and longitudinally between said keel stems, bowing outward therebetween to define a bilge chamber, said hull having an upper edge defined by said sides, each of said keel stems including a tab projecting above the upper edge of the hull as a continuation of the keel stem, said deck including a peripheral rail receivable over the upper edge of said hull, said rail having a pair of apertures defined vertically therethrough for receiving said tabs, each tab including a laterally directed lug engageable with said rail upon reception of the tab through the corresponding aperture to preclude retraction of said tab, said tabs being resiliently flexible for manual alignment of the lugs with said apertures for a withdrawal of the tabs therethrough.

26. The ark toy of claim 25 including a slot to each side of each tab defined in said hull inward from the upper edge thereof and parallel to the corresponding tab, said slots extending the effective height of the tabs and enhancing the flexibility thereof.

27. The ark toy of claim 25 including a central well in said deck, said well including forward and aft bulkheads, and a cabin including forward and aft walls received within said well immediately inward of said bulkheads, each bulkhead including a lower vertical portion and an upper outwardly inclined portion, the inclined portions defining guide surfaces for the positioning of the cabin within the well, and complementary means on said bulkheads and said cabin walls releasably locking said cabin within said well.

28. The ark toy of claim 27 wherein said complementary means comprises a flexible vertical tab on each cabin wall, an outwardly projecting lug on each tab, and a lug-receiving opening in each bulkhead adjacent the juncture between the upper inclined portions and the lower vertical portion.

* * * * *